US009339434B1

(12) United States Patent
Mayfield

(10) Patent No.: US 9,339,434 B1
(45) Date of Patent: May 17, 2016

(54) MAGNETICALLY COUPLED SLIDER SEX TOY

(71) Applicant: Paul Mayfield, Plano, TX (US)

(72) Inventor: Paul Mayfield, Plano, TX (US)

( * ) Notice: Subject to any disclaimer, the term of this patent is extended or adjusted under 35 U.S.C. 154(b) by 274 days.

(21) Appl. No.: 14/075,183

(22) Filed: Nov. 8, 2013

(51) Int. Cl.
*A61H 19/00* (2006.01)

(52) U.S. Cl.
CPC ..... *A61H 19/44* (2013.01)

(58) Field of Classification Search
CPC ..... A61H 19/44; A61H 19/00; A61H 19/40; A61H 2201/0153; A61H 2201/123; A61H 2201/1418; A61H 2201/149; A61H 2201/1666; A61H 2201/1669; A61H 2201/501; A61H 2201/5064; A61H 23/02; A61H 23/0218
See application file for complete search history.

(56) References Cited

U.S. PATENT DOCUMENTS

2004/0082831 A1* 4/2004 Kobashikawa ..... A61H 19/34 600/38

* cited by examiner

*Primary Examiner* — Christine H Matthews
(74) *Attorney, Agent, or Firm* — Michael Diaz

(57) ABSTRACT

A magnetically coupled slider sex toy apparatus. The apparatus includes a shaft having an interior and an elongated screw having first and second ends. The elongated screw is located within the interior of the shaft. The sex toy apparatus also includes a motor for rotating the elongated screw and an inner magnet coupled to the screw. The inner magnet moves longitudinally between the first and second ends of the screw. An outer magnetic ring is positioned over the shaft and is magnetically attracted to the inner magnet. Limits are located on either end of the shaft to send a signal to the elector motor of the position of the magnets. The electric motor is configured to reverse a direction of rotation of the elongated screw upon receipt of a signal from one of the limits which cause the inner magnet and outer magnet ring to move in an opposite direction.

17 Claims, 6 Drawing Sheets

MAGNETICALLY COUPLED SLIDER SEX TOY

BACKGROUND OF THE INVENTION

1. Field of the Invention

This invention relates to sex toys. Specifically, and not by way of limitation the present invention relates to a magnetically coupled slider toy for sexual stimulation.

2. Description of the Related Art

Many devices have been made to provide sexual stimulation or gratification through the history of man. There are many "sex toys" which have been constructed for men which stimulate the penis while there have been other sexual toys designed for women which simulate the structure and action of a penis. For some of these sex toys which simulate the structure of a penis, the sex toys have a phallic shape and are handheld. In recent years, some of the more popular of these devices include electric vibrators. However, in most cases, the person being stimulated by the sex toy or their partner must insert and move the device in or near the sexual organs of the stimulated person. This mechanical action of moving the device in and out is often necessary even when used in conjunction with a vibrator feature of the device. This in/out (back and forth) action can be cumbersome and tiring to the user of such devices. A device is needed which enables the user to insert the device into or near the sexual organs of the stimulated person without manual manipulation of the device to invoke an in/out sensation of the device into or near the user's sexual organs.

Thus, it would be advantageous to have an apparatus for sexually stimulating a person without requiring the manual movement of the apparatus to stimulate the person. Thus, it is an object of the present invention to provide such an apparatus.

SUMMARY OF THE INVENTION

In one aspect, the present invention is directed to a magnetically coupled slider sex toy apparatus. The apparatus includes a shaft having an interior and an elongated screw having first and second ends. The elongated screw is located within the interior of the shaft. The sex by apparatus also includes a motor for rotating the elongated screw and an inner magnet coupled to the screw. The inner magnet moves longitudinally between the first and second ends of the screw. An outer magnetic ring is positioned over the shaft and is magnetically attracted to the inner magnet. Limits are located on either end of the shaft to send a signal to the elector motor of the position of the magnets. The electric motor is configured to reverse a direction of rotation of the elongated screw upon receipt of a signal from one of the limits which cause the inner magnet and outer magnet ring to move in an opposite direction. The outer magnetic ring moves back and forth between the first and second ends of the shaft during rotation of the elongated screw by the motor.

In another aspect, the present invention is directed to a method of using a magnetically coupled slider sex toy apparatus. The method begins by an electric motor rotating an elongated screw located within an interior of a shaft of the sex toy apparatus. Upon rotation of the elongated screw, an inner magnet attached to the elongated screw moves within the interior of the shaft. Next, an outer magnetic ring position over the shaft is moved through a magnetic attraction with the inner magnet. The movement of the outer magnetic ring along the shaft is used to sexually stimulate a user.

In still another embodiment, the present invention is directed to a slider sex toy apparatus. The apparatus includes a shaft having an interior and an interior mounted driving mechanism for moving longitudinally between a first end and a second end of the interior of the shaft. In addition, the apparatus includes a motor for driving the interior mounted driving mechanism and an outer slider mechanism moving along an outer surface of the shaft. The slider mechanism is coupled to the interior mounted driving mechanism. The interior mounted driving mechanism and the coupled slider mechanism move from a first position to a second position during actuation of the motor. The movement of the outer slider mechanism along the shaft is used to sexually stimulate a user.

DESCRIPTION OF THE INVENTION

Figure 1:
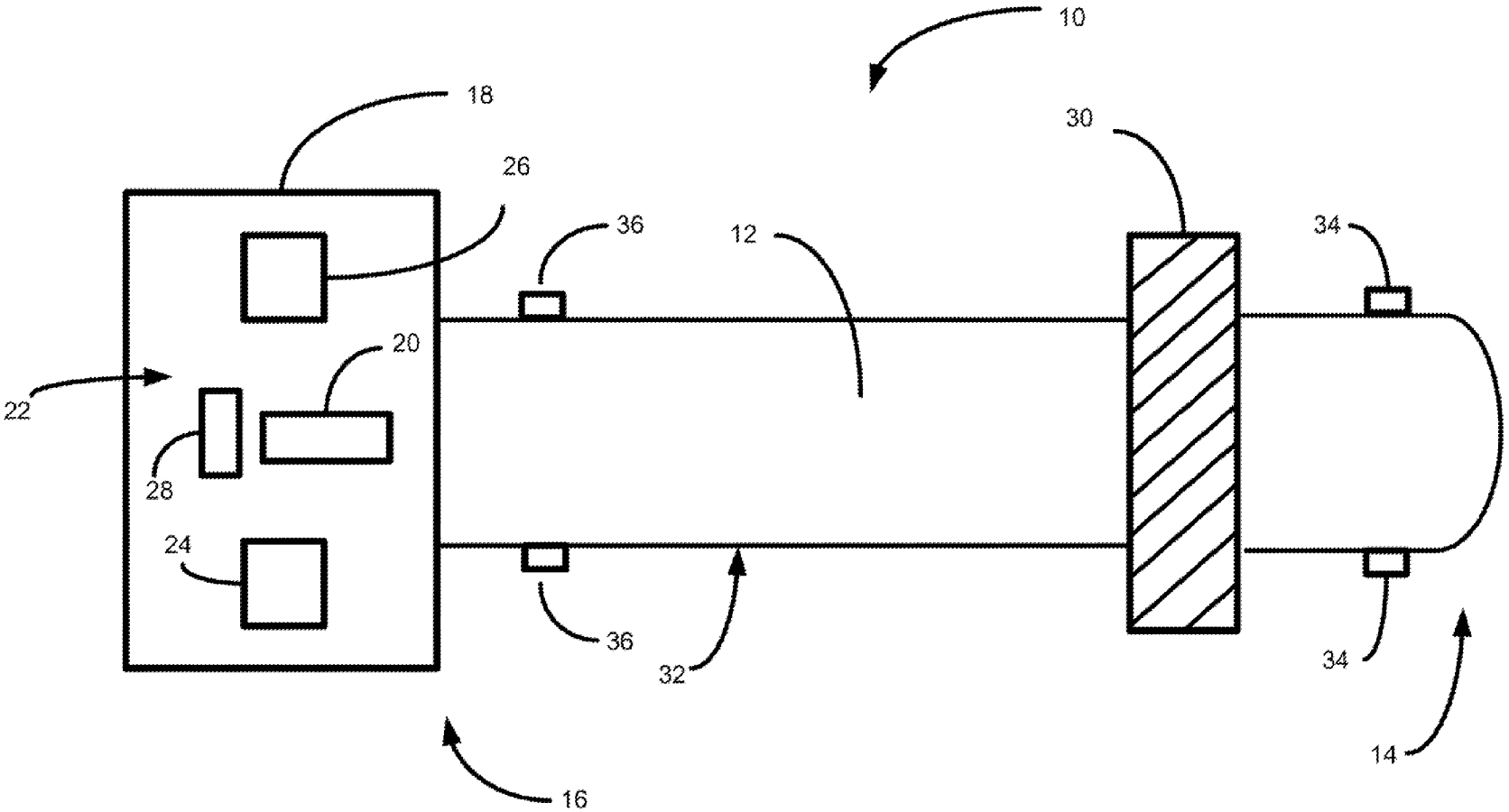
FIG. 1 is a side view of a slider sex toy in one embodiment of the present invention.

The present invention is a magnetically coupled slider sex toy. FIG. 1 is a side view of a slider sex toy 10 in one embodiment of the present invention. The sex toy 10 includes a shaft 12 having a substantially phallic or cylindrical shape which may, in one embodiment, be sized and shaped to simulate a man's penis. The shaft includes a first end 14 and an opposing second end 16. On the second end is a motor control section 18 housing an electric motor 20 and motor controls 22. The motor controls may include an on/off switch 24 for controlling the motor 20 and a speed switch 26 for selecting a variable speed of the motor 20. The motor may be powered by a battery 28, which may or may not be rechargeable. In another embodiment, the motor is powered by AC power connected through a plug to an AC electrical source (not shown). In still another embodiment, the AC electric source may be converted to DC power for use by the sex toy 10. In one example, a user may plug the sex toy 10 into a cigarette lighter in a car utilizing DC power from the car. The sex toy 10 includes an outer magnetic ring 30 which is sized and shaped to fit about an outer surface 32 of the shaft 12. The ring is adapted to slide longitudinally about the shaft 12. The outer surface 32 also includes one or more outer limit stops 34 and one or more inner limit stops 36.

Figure 2:
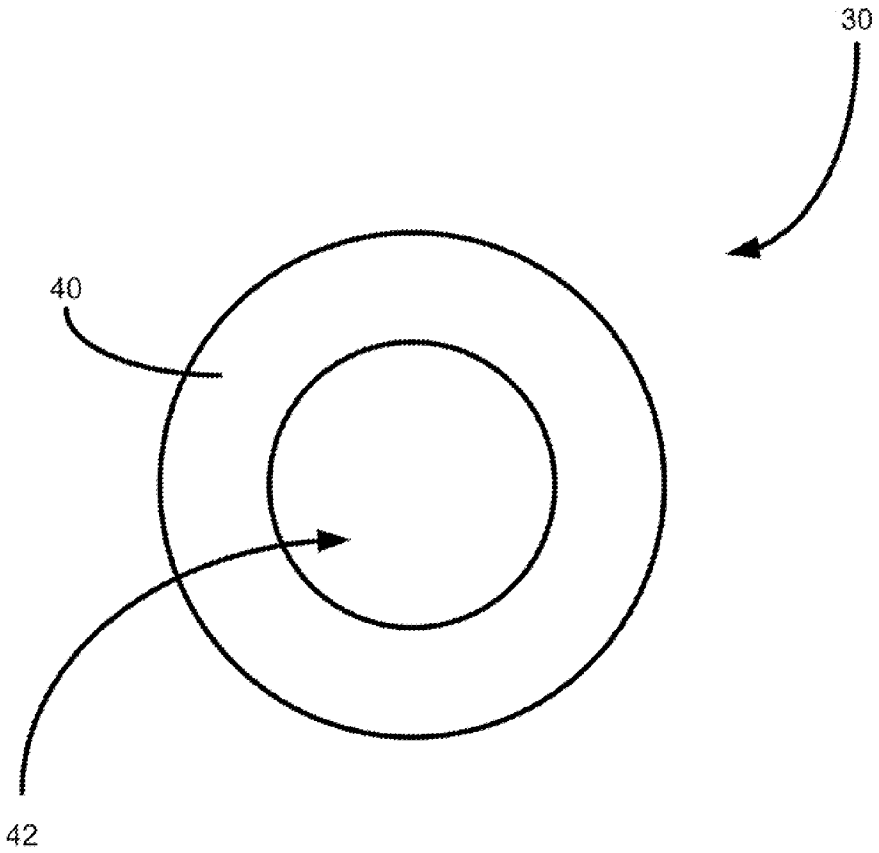
FIG. 2 is a top view of the outer magnetic ring separated from the slider sex toy of FIG. 1.

FIG. 2 is a top view of the outer magnetic ring 30. The outer magnet ring includes an annular body 40 having a bore 42 sized and shaped to allow the outer magnetic ring to slide freely upon the shaft 12. The outer magnetic ring is a magnet which is moved longitudinally by an inner magnet (see FIG. 3) along the outer surface 32. Although a circular shape is used, the outer magnetic ring may be any shape which is used as an exterior sliding mechanism capable of sliding on the outer surface of the shaft.

Figure 3:
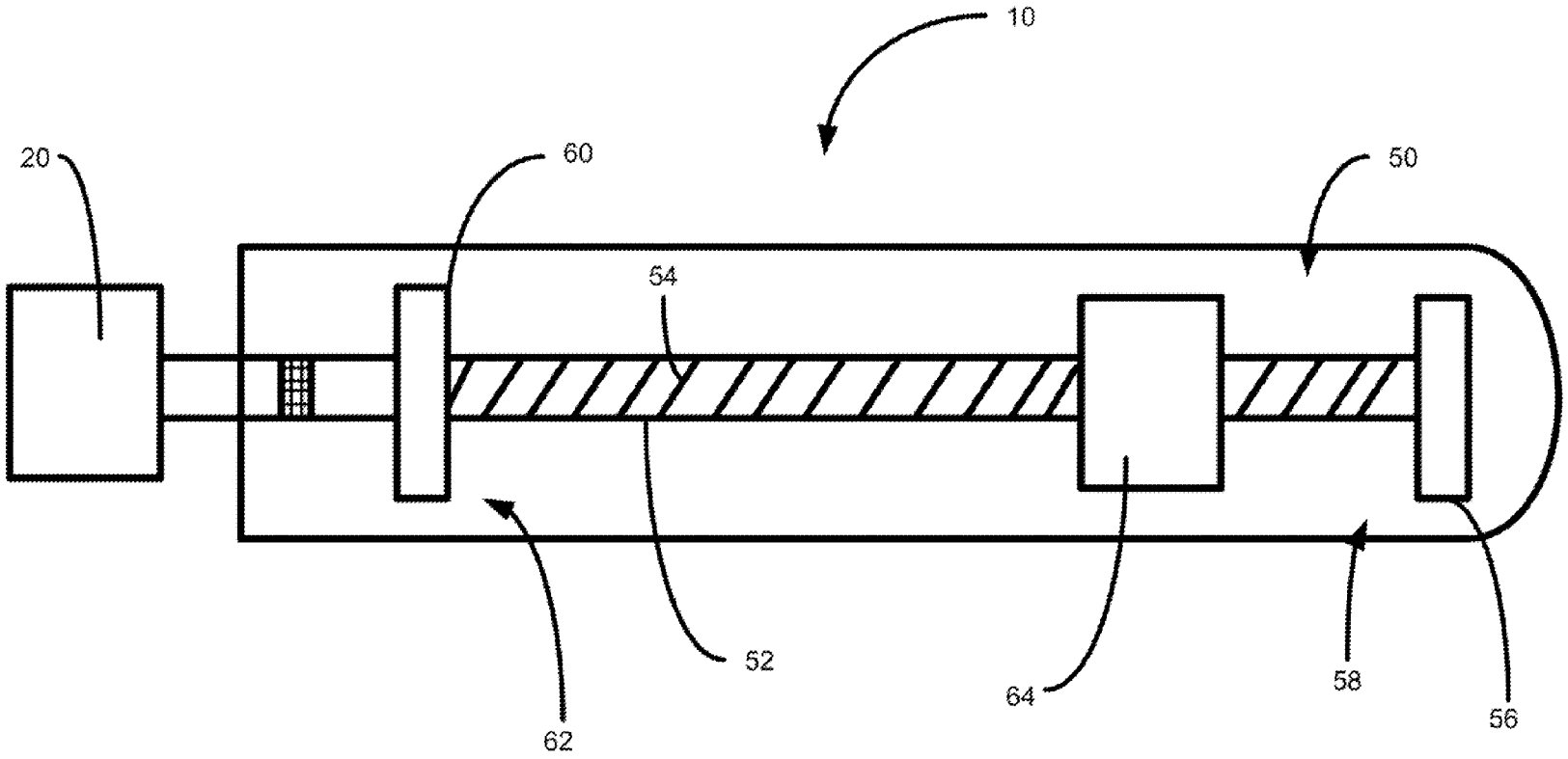
FIG. 3 is a side view illustrating an interior of the sex toy of FIG. 1.

FIG. 3 is a side view illustrating an interior 50 of the sex toy 10 of FIG. 1. The electric motor 20 is coupled to an elongated screw 52 running a substantial length of the interior 50 of the sex toy. The electric motor rotates the screw. The elongated screw may include a helical external thread 54. An inner magnet 64 is affixed to the screw in such a manner as to move longitudinally along the length of the elongated screw when the screw is rotated. The screw includes an end collar 56 located at an end 58 and a lower collar 60 located at a second end 62 of the screw. The collars 56 and 60 may be used to prevent movement of the inner screw 64 beyond a desired point on the elongated screw 52.

Figure 4:
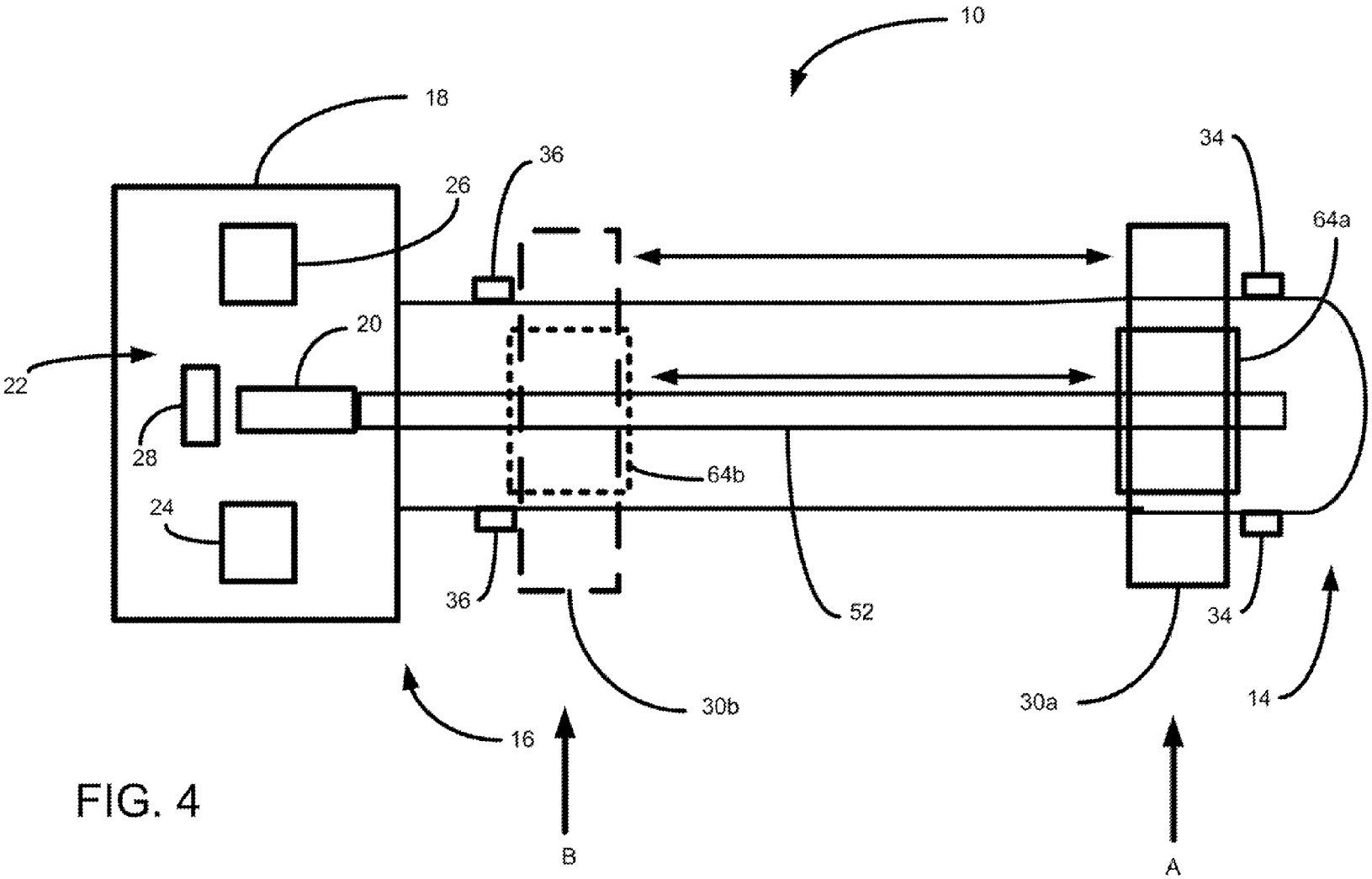
FIG. 4 is a side view illustrating various positions of the outer magnetic ring upon the shaft in one embodiment of the present invention.

FIG. 4 is a side view illustrating various positions of the outer magnetic ring 30 upon the shaft 12 in one embodiment of the present invention. The outer magnetic ring 30 moves in and out (back and forth) from position A where the outer limit stops 34 are located to position B where the inner limit stops 36 are located. As the magnetic ring 30 reaches the outer limit stops 34 at position A, illustrated as magnetic ring 30*a*, the limit stops may send a signal to the motor control section 18 to reverse the direction of the electric motor 20. Thus, the electric motor 20 reverses the direction of rotation of the elongated screw 52. The inner magnet 64, which runs along the elongated screw 52 then moves towards position B. The outer magnetic ring 30 follows the inner magnet because of the magnetic attraction between the inner magnet 64 and the outer magnetic ring 30. At position B, the outer magnetic ring 30 (illustrated as outer magnetic ring 30*b*) reaches the inner limit stops 36, where a signal is sent to the motor control section 18 to reverse the direction of rotation of the elongated screw 52. At this point, the inner magnet 64 (illustrated as inner magnet 84*b*) is located at position B. The motor then reverses direction, causing the inner magnet 64 to move outward toward the end 58. Thus, the inner magnet 64 and the accompanying outer magnetic rind 30 move from position A to B and back to A. The user then receives a sensation of movement of the shaft as a back and forth (in and out) motion.

With reference to FIGS. 1-4, the operation of the sex toy 10 will now be explained. In one embodiment, the sex toy may be utilized by a woman. The shaft 12 of the sex toy 10 may be inserted within a vagina of the user. The on/off switch 24 may be switched to the on position, thereby activating the electric motor 20. The electric motor then rotates the elongated screw 52, causing movement of the inner magnet 64 from position A to position B. As the inner magnet 64 moves longitudinally toward the end 58, the outer magnetic ring 30, located on the outer surface 32 of the shaft 12, follows the inner magnet 64. When the outer magnetic ring 30 reaches the outer limit stops 34, a signal is sent to the motor control section 18. Upon receiving the limit signal from the limit stops, the motor reverses direction of the elongated screw, thereby reversing the direction of the inner magnet within the interior of the shaft. The inner magnet then moves toward position B. When the outer magnet ring 30 reaches the inner limit stops 36, the limits send a signal to the motor control section 18. Upon receipt of the limit signal, the motor again reverses direction of the elongated screw, which again reverses the direction of the inner magnet. With the reversal of direction, the outer magnetic ring 30 follows in the reverse direction toward position A. This back and forth movement between positions A and B results in an in and out sensation of the shaft within the vagina of the user. When the user desires to deactivate the sex toy, the user may switch the sex toy off by switching the on/off switch to off and removing the sex toy. Additionally, the user may vary the speed of the motion of the outer magnetic ring 30 by using the speed switch 26 to vary the speed of the motor.

The outer magnetic ring may have a silicon coating or other material to prevent discomfort and provide protection to the user. Likewise, the shaft may also include a silicon coating or other material as desired. The present invention also is not limited to woman and internal use within a vagina and may be used by men and positioned in various locations of the user's body. In addition, although stop limits are discussed, any mechanism may be used which sends a signal to the motor that the outer magnetic ring has reached a certain limit. In addition, in another embodiment of the present invention, the shaft may include a vibrating feature. A vibrator may be incorporated within the shaft to provide additional movement of the shaft. The present invention provides a unique feature providing the sensation of the shaft moving while using a magnetically coupled mechanism to achieve movement of the outer magnetic ring.

Figure 5A:
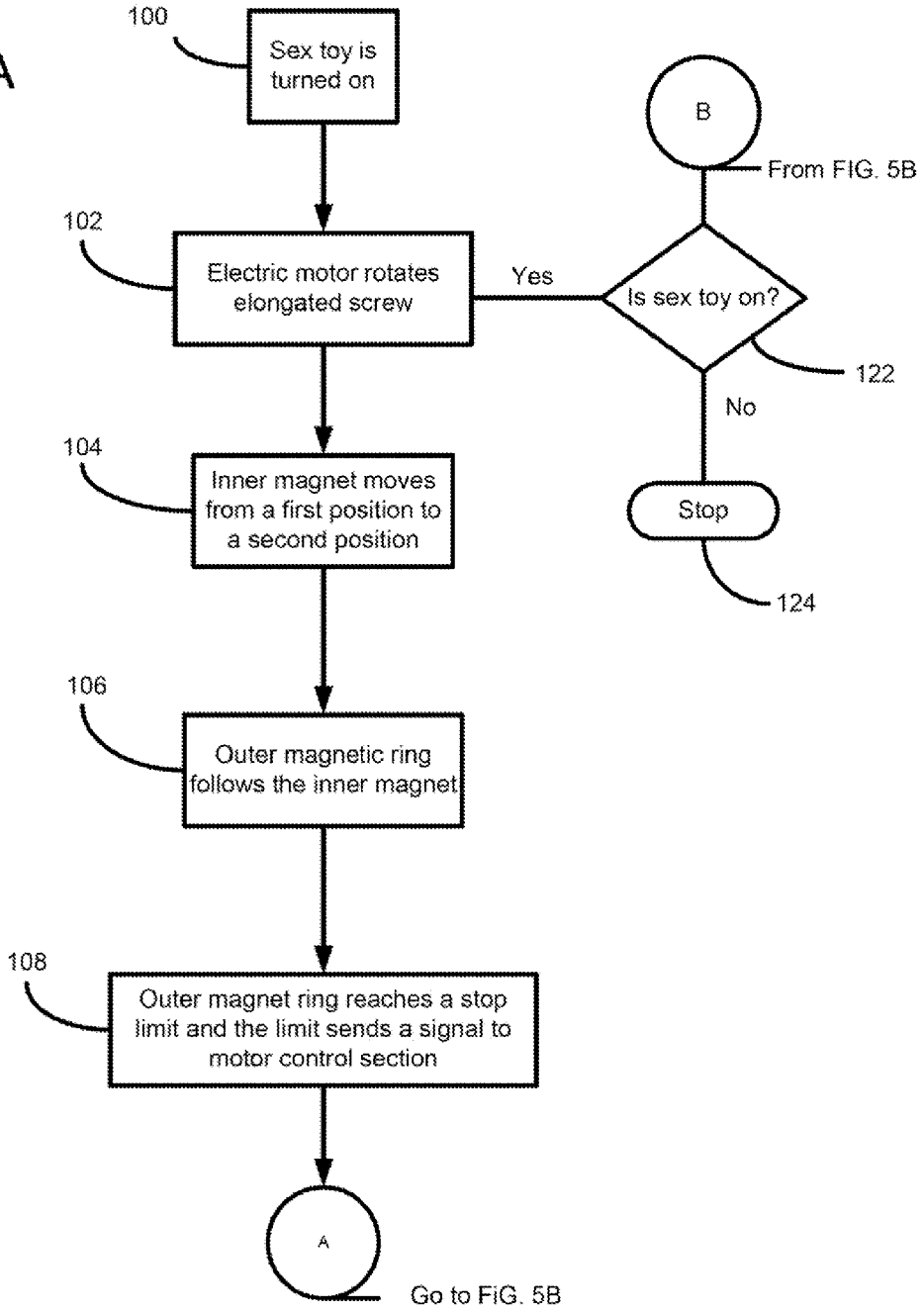
FIGS. 5A and 5B are flowcharts illustrating the steps of operating the sex toy according to the teachings of the present invention.
Figure 5B:
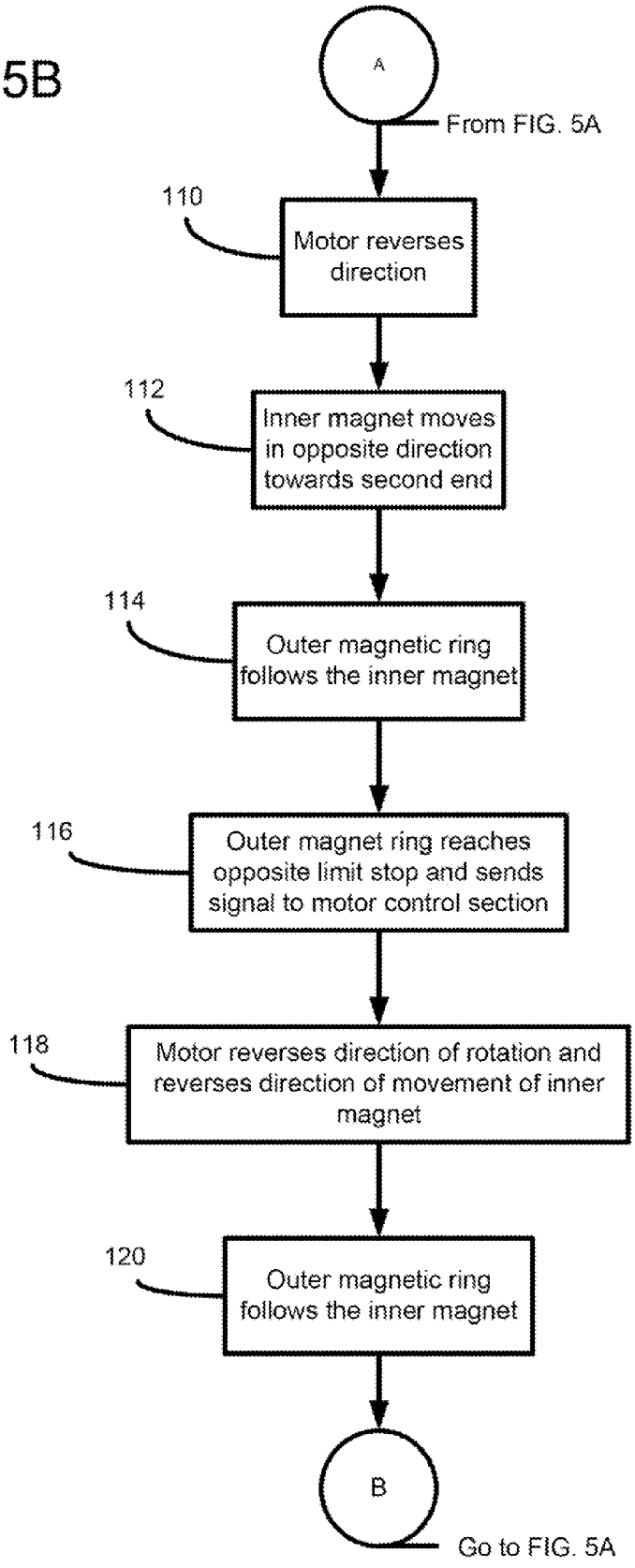

FIGS. 5A and 5B are flowcharts illustrating the steps of operating the sex toy 10 according to the teachings of the present invention. With reference to FIGS. 1-5, the method will now be explained. The method begins with step 100 where the on/off switch 24 may be switched to the on position to activate the electric motor 20. Next, in step 102, the electric motor rotates the elongated screw 52. With the rotation of the elongated screw, the method then moves to step 104 where the inner magnet 64 moves from a first position to a second position (e.g., position A to position B). Next, in step 106, as the inner magnet 64 moves longitudinally toward the second end (e.g., end 58), the outer magnetic ring 30, located on the outer surface 32 of the shaft 12, follows the inner magnet 64 due to the magnetic attraction between the inner magnet 64 and the outer magnetic ring 30. Next, in step 108, the outer magnetic ring 30 reaches one of the limit stops (e.g., the outer limit stops 34) resulting in the transmittal of a signal to the motor control section 18. Upon receiving the limit signal from the limit stops, in step 110, the motor reverses direction of the elongated screw, thereby reversing the direction of the inner magnet within the interior of the shaft. Next, in step 112, the inner magnet then moves in the opposite direction toward the second end (e.g., toward position B). Next, in step 114, as the inner magnet 64 moves longitudinally toward position B, the outer magnetic ring 30, located on the outer surface 32 of the shaft 12, follows the inner magnet 64 due to the magnetic attraction between the inner magnet 64 and the outer magnetic ring 30. The method then moves to step 116, where the outer magnet ring 30 reaches the opposite limit stop (e.g., inner limit stops 36) and the stop limits send a signal to the motor control section 18. Next, in step 118, upon receipt of the limit signal, the motor again reverses direction of the elongated screw, which reverses the direction of the inner magnet. With the reversal of direction, in step 120, the outer magnetic ring 30 follows in the reverse direction toward the opposite direction (e.g., position A). Next, in step 122 (see FIG. 5A), it is determined if the sex toy is still on. If the toy has been turned off, the method moves to step 124 where the process is stopped. However, in step 122, if it is determined that the sex toy is still on, the method begins the process again by moving to step 102 where the electric motor rotates the screw and the process begins again. This back and forth movement between positions A and B results in an in and out sensation for the user and continues until the sex toy is turned off.

In another embodiment, the sex toy 10 may also have any shape of an outer magnet. For example, the outer magnetic ring 30 may be square or elliptical and is not limited to a circular shape. Furthermore, although an elongated screw is used to drive the inner magnet, in another embodiment, any type of mechanism may be used which moves the inner magnet longitudinally through the interior of the shaft. For example, a cable and pulley system or conventional rack in pinion gear system may be used to drive the inner magnet. In still another embodiment, rather than utilizing magnets to drive the outer sliding mechanism (outer magnetic ring), a mechanical connection (e.g., cables, strut, etc.) between an interior mounted driving mechanism and the outer sliding mechanism may be used whereby by the motor moves the interior mounted driving mechanism which is physically connected to the outer sliding mechanism to providing movement of the outer sliding mechanism.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

Thus, the present invention has been described herein with reference to a particular embodiment for a particular application. Those having ordinary skill in the art and access to the present teachings will recognize additional modifications, applications and embodiments within the scope thereof.

It is therefore intended by the appended claims to cover any and all such applications, modifications and embodiments within the scope of the present invention.

What is claimed is:

1. A magnetically coupled slier sex toy apparatus, the apparatus comprising:

a shaft having an interior;

an elongated screw having a first end and a second end, the elongated screw located within the interior of the shaft;

a motor for rotating the elongated screw;

an inner magnet coupled to the screw, the inner magnet moving between the first end and second end of the screw;

an outer magnetic ring positioned over the shaft, the outer magnetic ring being attracted to the inner magnet;

whereby the inner magnet and accompanying outer magnetic ring move from a first position to a second position during rotation of the elongated screw by the motor.

2. The apparatus according to claim 1 further comprising:

a first limit located on a first end of the shaft and a second limit located on an opposite second end of the shaft;

a first limit stop associated with the first limit and a second limit stop associated with the second limit;

wherein the first and second stops send a signal to the motor when the outer magnetic ring reaches one of the limits.

3. The apparatus according to claim 2 wherein the motor is configured to reverse a direction of rotation of the elongated screw upon receipt of a signal from one of the limits; thereby causing the inner magnet and outer magnet ring to move in an opposite direction along the shaft.

4. The apparatus according to claim 3 wherein the movement of the outer magnetic ring from the first end of the shaft to the second end of the shaft simulates a back and forth movement of the shaft.

5. The apparatus according to claim 4 wherein the shaft has a phallic shape and the shaft is configured for use within a woman's vagina.

6. The apparatus according to claim 1 wherein the shaft includes a vibrator for vibrating the shaft.

7. The apparatus according to claim 1 wherein the motor includes a speed variance mechanism for varying the speed of the motor.

8. The apparatus according to claim 1 wherein the outer magnetic ring includes a silicon coating.

9. A slider sex toy apparatus, the apparatus comprising:

a shaft having an interior;

an interior mounted driving mechanism for moving longitudinally between a first end and a second end of the interior of the shaft;

a motor for driving the interior mounted driving mechanism;

an outer slider mechanism moving along an outer surface of the shaft, the slider mechanism coupled to the interior mounted driving mechanism;

wherein the interior mounted driving mechanism and the coupled slider mechanism move from a first position to a second position during actuation of the motor;

wherein the outer slider mechanism and interior mounted driving mechanism are magnets magnetically attracted to each other, the outer slider mechanism configured to follow the interior mounted driving mechanism during movement of the interior mounted driving mechanism.

10. The slider sex toy apparatus according to claim 9 wherein the outer slider mechanism is physically coupled to the interior mounted driving mechanism, the outer slider mechanism configured to follow the interior mounted driving mechanism during movement of the interior mounted driving mechanism.

11. The slider sex toy apparatus according to claim 9 further comprising:

a first limit located adjacent a first end of the shaft and a second limit located on an opposite second end of the shaft;

a first limit stop associated with the first limit and a second limit stop associated with the second limit;

wherein the first and second limit stops send a signal to the motor when the outer slider mechanism reaches one of the limits;

wherein the motor is configured to reverse a direction of movement of the interior mounted driving mechanism upon receipt of a signal from one of the limit stops, thereby causing the interior mounted driving mechanism and the outer slider mechanism to move in an opposite direction.

12. The slider sex toy apparatus according to claim 9 wherein the motor is configured to drive the interior mounted driving mechanism using a rotating elongated screw.

13. The slider sex toy apparatus according to claim 9 wherein the motor is configured to drive the interior mounted driving mechanism using a cable and pulley system.

14. The slider sex toy apparatus according to claim 9 wherein the motor is configured to drive the interior mounted driving mechanism using a rack in pinion gear system.

15. The slider sex toy apparatus according to claim 9 wherein the outer slider mechanism is a ring having an opening sized and shaped to securely fit over the outer surface of the shaft.

16. A method of using a magnetically coupled slider sex toy apparatus, the method comprising the steps of:

rotating, by an electric motor, an elongated screw located within an interior of a shaft of the sex toy apparatus;

upon rotation of the elongated screw, moving an inner magnet attached to the elongated screw;

moving, by magnetic attraction with the inner magnet, an outer magnetic ring positioned over the shaft; and using the movement of the outer magnetic ring along the shaft to sexually stimulate a user.

17. The method according to claim 16 further comprising the steps of:

upon the outer magnetic ring reaching a first limit on the shaft, reversing a direction of rotation of the elongated screw; and upon reversing the direction of the screw, moving the inner magnet and outer magnetic ring in an opposite direction.

* * * * *